US008537066B2

(12) United States Patent
Libonati et al.

(10) Patent No.: US 8,537,066 B2
(45) Date of Patent: Sep. 17, 2013

(54) TRUNCATED BICONICAL DIPOLE ANTENNA WITH DIELECTRIC SEPARATORS AND ASSOCIATED METHODS

(75) Inventors: Russell W. Libonati, Melbourne, FL (US); Larry Goldstein, Melbourne, FL (US); Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 215 days.

(21) Appl. No.: 13/217,662

(22) Filed: Aug. 25, 2011

(65) Prior Publication Data

US 2013/0050040 A1 Feb. 28, 2013

(51) Int. Cl.

| | |
|---|---|
| ***H01Q 13/00*** | (2006.01) |
| ***H01Q 9/28*** | (2006.01) |
| ***H01Q 9/16*** | (2006.01) |

(52) U.S. Cl.

USPC ..... 343/773; 343/772; 343/793; 343/807; 343/774

(58) Field of Classification Search

None

See application file for complete search history.

(56) References Cited

U.S. PATENT DOCUMENTS

| | | | | |
|---|---|---|---|---|
| 2,175,252 | A | 10/1939 | Carter | 250/33 |
| 3,829,863 | A * | 8/1974 | Lipsky | 343/773 |
| 4,125,840 | A * | 11/1978 | Cassel | 343/807 |
| 5,105,199 | A * | 4/1992 | Ukmar | 343/791 |
| 6,864,853 | B2 * | 3/2005 | Judd et al. | 343/844 |
| 7,221,326 | B2 | 5/2007 | Ida et al. | 343/773 |
| 7,339,542 | B2 | 3/2008 | Lalezari | |
| 8,228,257 | B2 * | 7/2012 | Lalezari | 343/850 |
| 8,314,744 | B2 * | 11/2012 | Libonati et al. | 343/807 |
| 2009/0237314 | A1 * | 9/2009 | Lalezari | 343/773 |
| 2012/0081260 | A1 * | 4/2012 | Wong et al. | 343/807 |
| 2012/0188137 | A1 * | 7/2012 | Lalezari | 343/773 |
| 2013/0050040 | A1 * | 2/2013 | Libonati et al. | 343/773 |

* cited by examiner

*Primary Examiner* — Trinh Dinh

(74) *Attorney, Agent, or Firm* — Allen, Dyer, Doppelt, Milbrath & Gilchrist, PA

(57) ABSTRACT

The antenna assembly includes first and second adjacent antenna elements each having a tapered or conical antenna body with a base and an apex opposite the base. An elongated or cylindrical antenna body extends from the base of the conical antenna body, and includes a plurality of adjacent elongated or cylindrical antenna body portions, and a respective dielectric member separating adjacent cylindrical antenna body portions. Each of the first and second adjacent antenna elements are aligned along a common longitudinal axis with respective apexes in opposing relation to define a dipole antenna. Increased radiation pattern bandwidth and satisfactory pattern on the horizon may be achieved in such a biconical-type antenna.

24 Claims, 8 Drawing Sheets

TRUNCATED BICONICAL DIPOLE ANTENNA WITH DIELECTRIC SEPARATORS AND ASSOCIATED METHODS

FIELD OF THE INVENTION

The present invention relates to the field of antennas, and, more particularly, to dipole antennas with broad pattern bandwidth and related methods.

BACKGROUND OF THE INVENTION

A particular type of antenna may be selected for use in an electronic device based upon a desired application. For example, a different type of antenna may be used for terrestrial communications versus satellite communications. The type of antenna used may also be based upon a desired operating frequency of the antenna.

One example of a type of antenna is a broadband antenna. A broadband antenna is an antenna that operates over a wide range of frequencies. The broadband antenna may be formed to provide increased gain along the horizon, for example, during terrestrial communications.

One type of broadband antenna is a biconical dipole antenna. A biconical dipole antenna has inherent broadband characteristics as it functions as a self excited horn. The conical horn walls fit different sized waves. However, the diameter of a biconical antenna becomes increasingly large at lower operational frequencies. A larger diameter or size may be restricted in a mobile wireless communications device as the size of the housing carrying the biconical antenna may be limited in size. To reduce the size of the biconical antenna, the biconical antenna may be truncated. As a result, a dipole-type structure is formed.

Increased antenna performance at lower frequencies may correspond to increased antenna length. However, at higher frequencies the increased length may result in the formation of lobes in the antenna pattern, thus resulting in relatively low gain on the horizon. In fact, another radiation pattern lobe is formed for every half wavelength of wire dipole length. Electrically large thin wire dipole antennas have nearly endfire radiation rather than broadside radiation.

For example, referring now to the biconical antenna 170 in FIG. 1*a*, and the graphs in FIGS. 1*b*-1*c*, the biconical antenna has relatively satisfactory performance at the horizon both for low (FIG. 1*b*) and high (FIG. 1*c*) frequencies. However, the biconical antenna has a relatively large diameter, for example, 15.5" tall by 15.3" in diameter, for a desired operating frequency range.

Additionally, referring to the truncated biconical antenna 180 (i.e. dipole with biconical feed) in FIG. 2*a*, and the graphs in FIGS. 2*a*-2*c*, the truncated biconical antenna feed has relatively satisfactory performance at the horizon at low frequencies (FIG. 2*b*). The dominate dipole structure may be too long for the higher frequencies, which illustratively causes a lobe to form at the horizon (FIG. 2*c*). Example dimensions for the truncated biconical dipole are 15.5" tall×4" in diameter for the desired operating frequency range.

U.S. Pat. No. 7,221,326 to Ida et al. discloses a biconical antenna. More particularly, the biconical antenna includes a columnar dielectric member having frustum-shaped cavities extending respectively from an upper and lower surface toward the center of the columnar member. Flat surfaces of apex portions of the frustum-shaped cavities are parallel and in opposition to one another.

U.S. Pat. No. 2,175,252 to P. S. Carter discloses conical monopole and conical dipole antennas with a coaxial cable feed. The cone forms a sleeve over the coaxial cable.

U.S. Pat. No. 7,339,542 to Lalezari. discloses an ultra-broadband antenna system that combines an asymmetrical dipole element and a biconical dipole element to form a monopole. The asymmetrical dipole element includes upper and lower asymmetrical dipole elements. The antenna system also includes a plastic expander ring coupled to the lower asymmetrical dipole element. The expander ring is also coupled to a canister sub-assembly. A choke sub-assembly is provided within the canister sub-assembly.

However, there may still be a need for a reduced diameter antenna profile, such as a cylindrical "whip" profile, including an increased radiation pattern bandwidth and a satisfactory pattern on the horizon.

SUMMARY OF THE INVENTION

In view of the foregoing background, it is therefore an object of the present invention to provide an increased radiation pattern bandwidth and a satisfactory pattern on the horizon in a biconical-type antenna.

This and other objects, features, and advantages in accordance with the present invention are provided by an antenna assembly including first and second adjacent antenna elements each comprising a tapered or conical antenna body having a base and an apex opposite the base, an elongated or cylindrical antenna body extending from the base of the conical antenna body, and including a plurality of adjacent elongated or cylindrical antenna body portions, and a respective dielectric member separating adjacent cylindrical antenna body portions. Each of the first and second adjacent antenna elements are aligned along a common longitudinal axis with respective apexes in opposing relation to define a dipole antenna.

Each of the plurality of cylindrical antenna body portions may comprise a tubular cylindrical antenna body portion, a solid cylindrical antenna body portion, a mesh electrical conductor and/or a continuous electrical conductor. Each of the dielectric members may comprise a cylindrical dielectric member, and a diameter of each of the cylindrical dielectric members may be different than a diameter of adjacent cylindrical antenna body portions. The mesh electrical conductor may comprise insulated wire.

An antenna feed assembly may be coupled to the first and second adjacent antenna elements. The plurality of adjacent cylindrical body portions may include at least three cylindrical body portions with respective dielectric members therebetween.

A method aspect is directed to making an antenna assembly including forming first and second adjacent antenna elements each comprising a conical antenna body having a base and an apex opposite the base, a cylindrical antenna body extending from the base of said conical antenna body, and including a plurality of adjacent cylindrical antenna body portions, and a respective dielectric member separating adjacent cylindrical antenna body portions. The method further includes aligning each of the first and second adjacent antenna elements along a common longitudinal axis with respective apexes in opposing relation to define a dipole antenna.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1A:
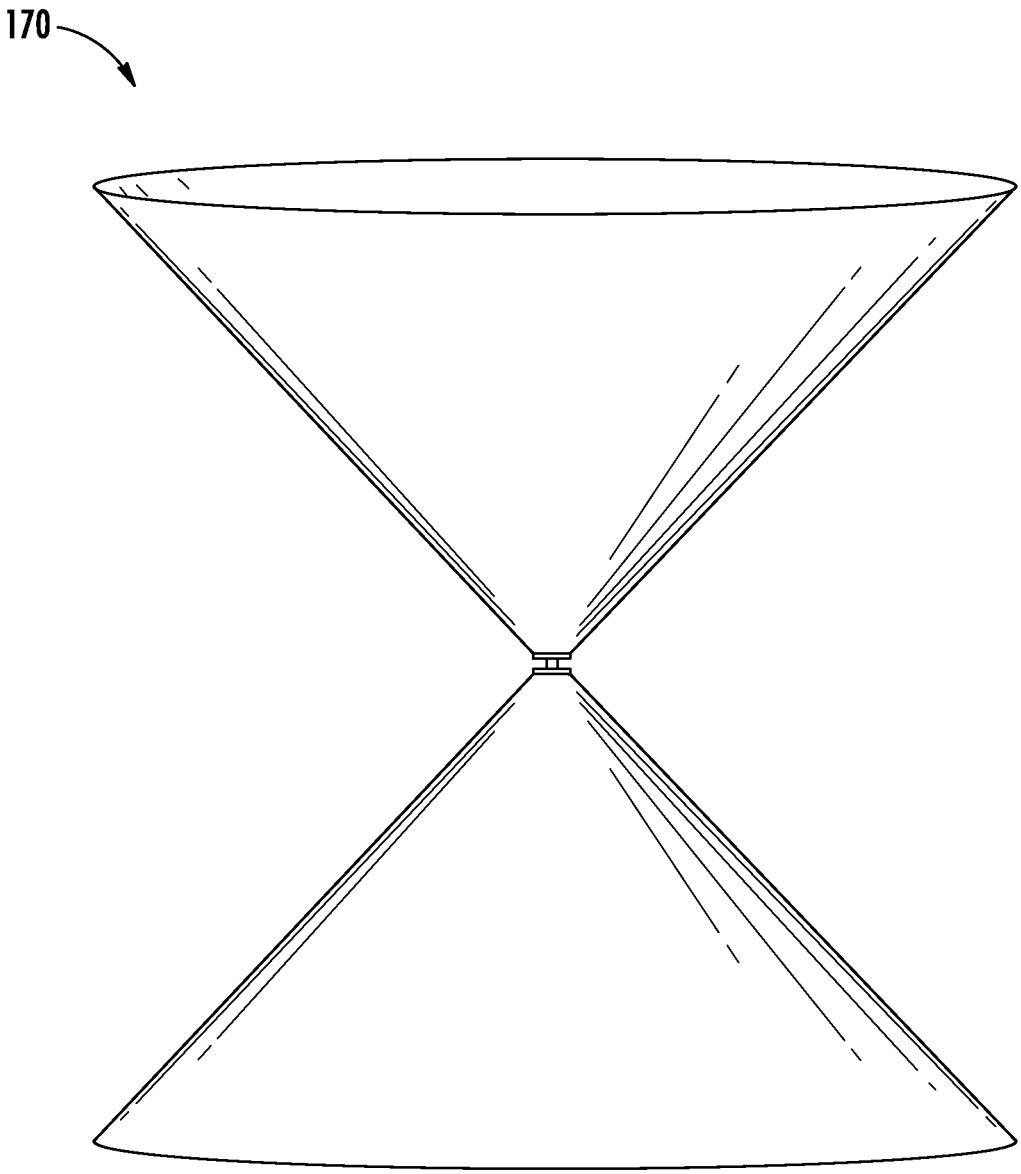
FIG. 1A PRIOR ART
FIG. 1A is a schematic view of a biconical antenna in accordance with the prior art.
Figure 1C:
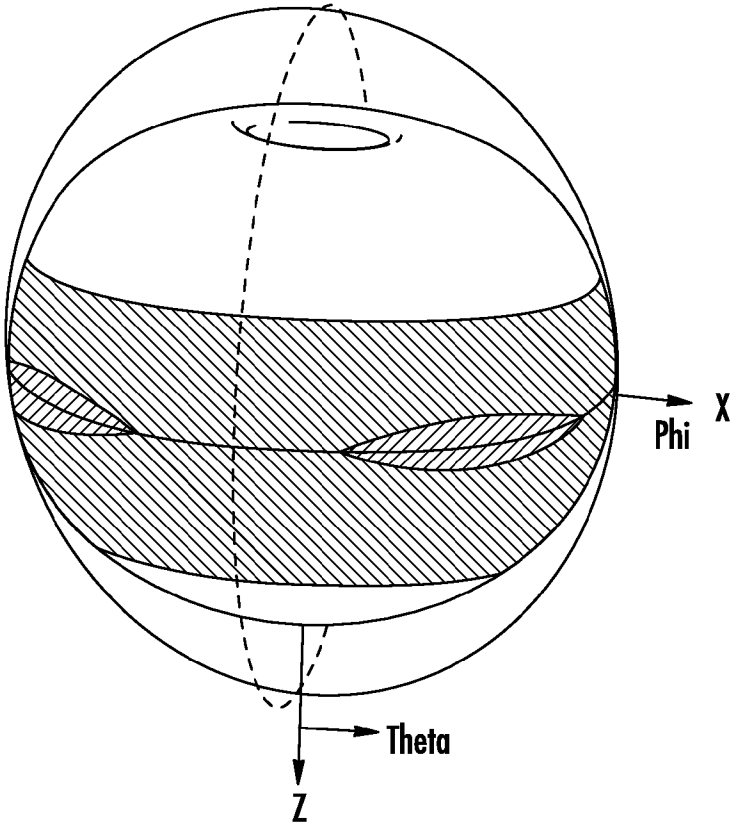
FIG. 1C PRIOR ART
FIGS. 1B and 1C are respective graphs of low and high frequency radiation patterns of the biconical antenna of FIG. 1A.
Figure 1B:
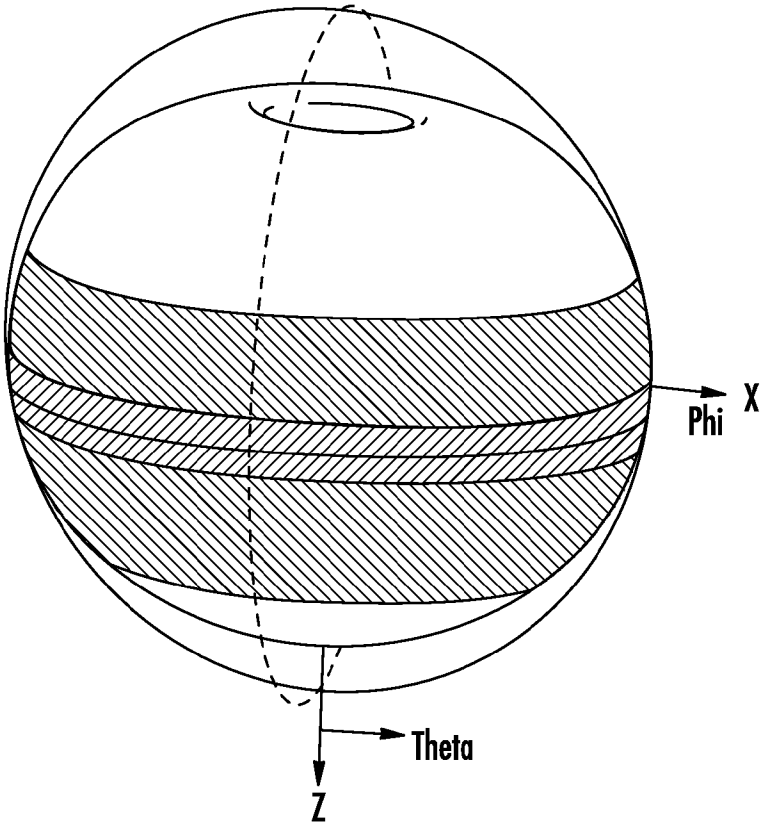
FIG. 1B PRIOR ART
Figure 2A:
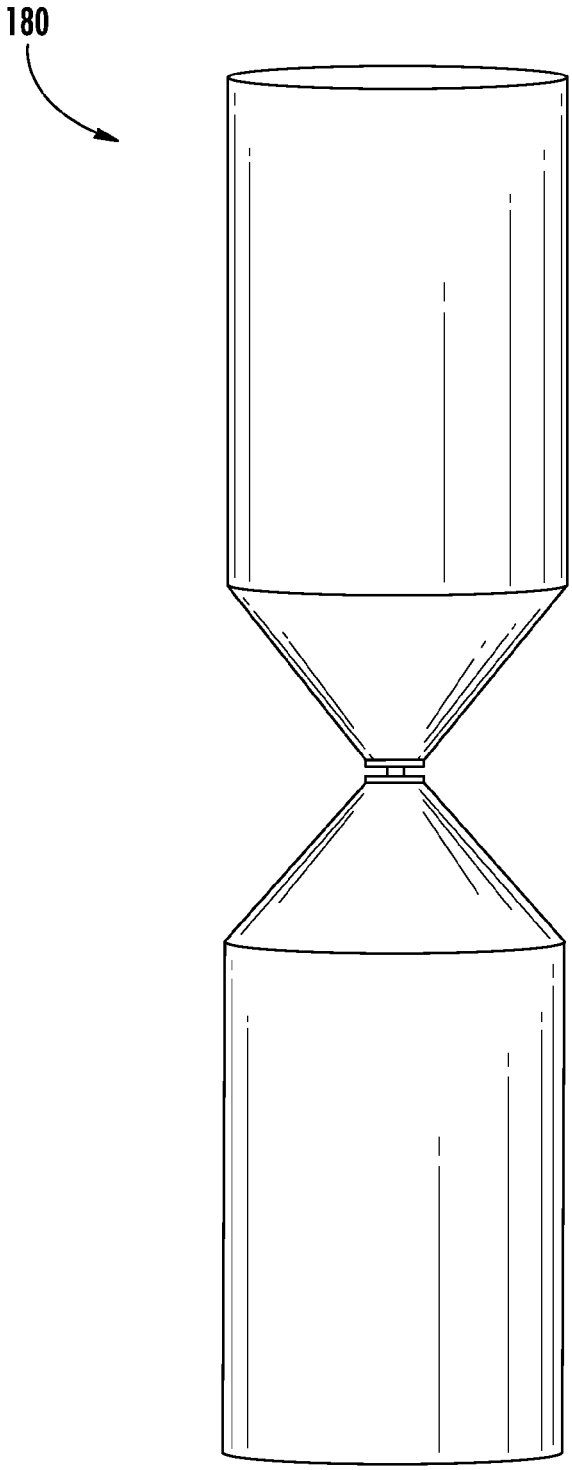
FIG. 2A PRIOR ART
FIG. 2A is a schematic view of a truncated biconical antenna in accordance with the prior art.
Figure 2C:
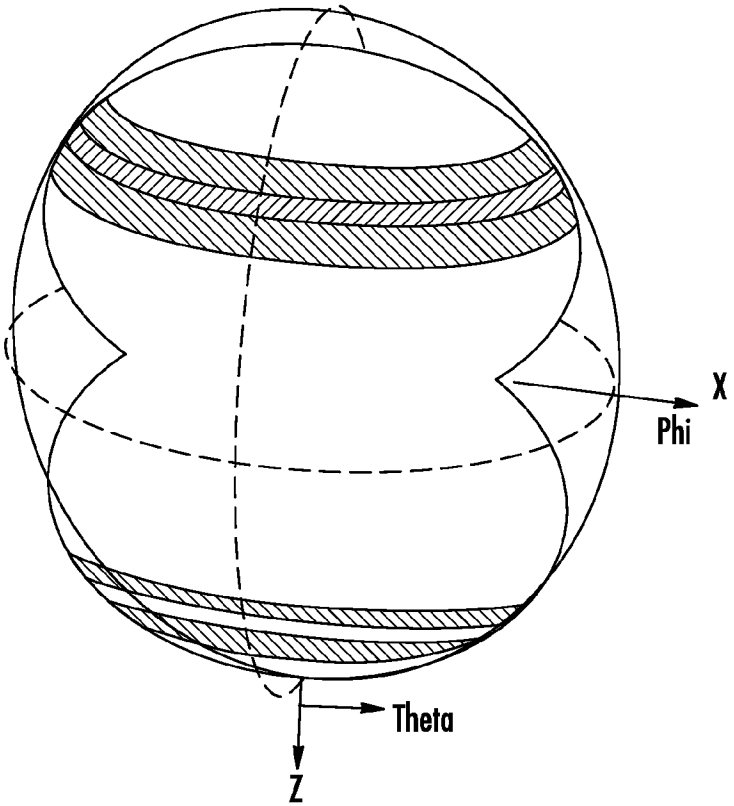
FIG. 2C PRIOR ART
FIGS. 2B and 2C are respective graphs of low and high frequency gain patterns of the truncated biconical antenna of FIG. 2A.
Figure 2B:
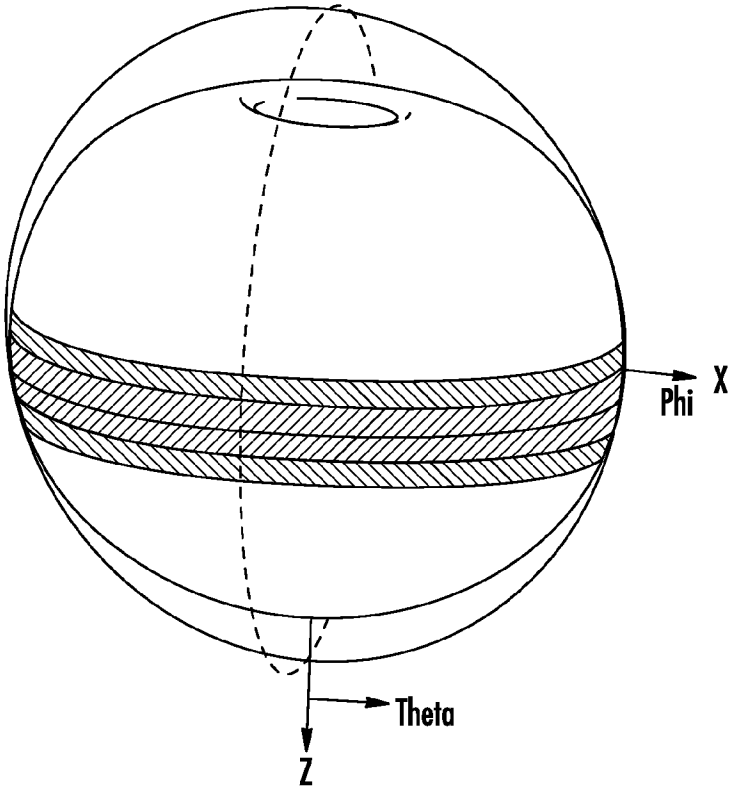
FIG. 2B PRIOR ART
Figure 3A:
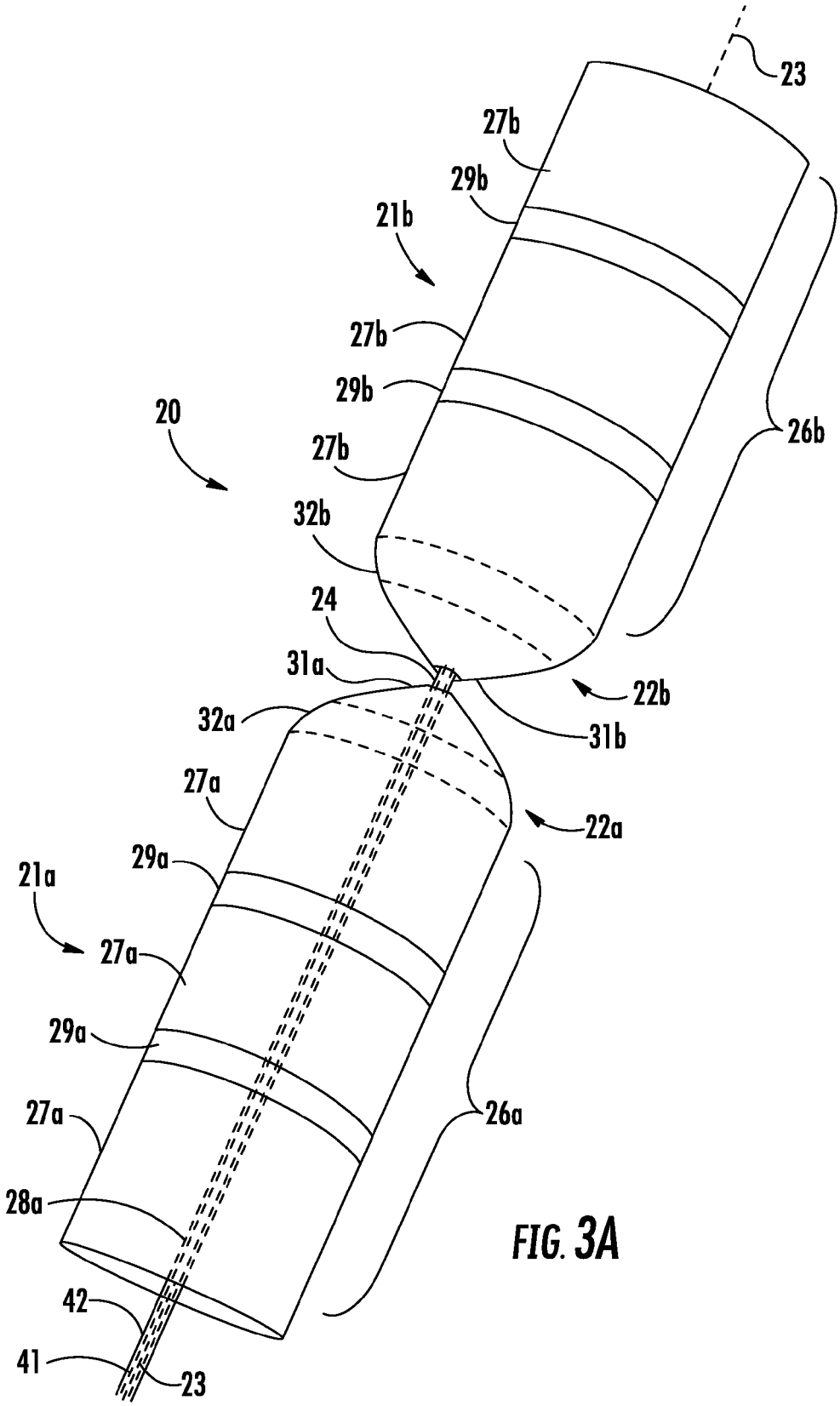
FIG. 3A is a perspective view of an antenna assembly in accordance with the present invention.

Referring initially to FIG. 3, an antenna assembly 20 includes first and second adjacent antenna elements 21*a*, 21*b*. Each of the first and second adjacent antenna elements 21*a*, 21*b* includes a tapered or conical antenna body 22*a*, 22*b* having a base 32*a*, 32*b* and an apex 31*a*, 31*b* opposite the base.

Each conical antenna body 22*a*, 22*b* has two-stages defining a step therebetween. As will be appreciated by those skilled in the art, the two-step conical antenna body 22*a*, 22*b* may be used to match a return loss. An approximation of a curve corresponding to a desired return loss at a desired frequency may be accomplished by adding additional stages to form the conical antenna body 22*a*, 22*b*. The two-stage conical antenna body 22*a*, 22*b* provides improved return loss performance over a single-plane conical antenna body. Of course, each conical antenna body 22*a*, 22*b* may be formed having a single stage or more than two stages. Moreover, the stages may be formed to define any shape, but an overall spherical shape of the conical antenna body is less desired, for example, for wideband frequency operation.

An increase in the size or diameter of each conical antenna body 22*a*, 22*b* advantageously increases performance. For example, an increase in the diameter of the base 32*a*, 32*b* of the conical antenna body 22*a*, 22*b* corresponds to an increase in frequency bandwidth. Thus, the diameter of each conical antenna body 22*a*, 22*b* may be determined based upon a compromise of desired size and desired performance.

Each of the first and second adjacent antenna elements 21*a*, 21*b* also includes an elongated or cylindrical antenna body 26*a*, 26*b* extending from the base 32*a*, 32*b* of the conical antenna body 22*a*, 22*b*. Each cylindrical antenna body 26*a*, 26*b* includes a plurality of elongated or cylindrical antenna body portions 27*a*, 27*b*. Also, each of the first and second adjacent antenna elements 21*a*, 21*b* includes a respective dielectric member 29*a*, 29*b* separating adjacent cylindrical antenna body portions.

Such dielectric members 29*a*, 29*b* may be formed of foam, graphite or PTFE, for example. The plurality of cylindrical antenna body portions 27*a*, 27*b* and dielectric members 29*a*, 29*b* may be secured together in various ways included being threaded together, slid together and/or adhered together, for example.

The longitudinally spaced distance between the cylindrical antenna body portions 27*a*, 27*b* due to the dielectric members 29*a*, 29*b* advantageously affects the performance of the antenna. For example, the longitudinally spaced distance between cylindrical antenna body portions 27*a*, 27*b* affects the radiation pattern and/or return loss by altering the location of lobes in the gain pattern. The gaps created by the separation may control the phasing of current, and the plurality of cylindrical antenna body portions 27*a*, 27*b* may be considered to operate as a series-fed array.

Additional dielectric members (not shown) may be included in the cylindrical antenna body 26*a*, 26*b*. Thus additional lobe control may be provided. Reduction of "lobing" at other or additional frequencies may be accomplished by adjusting the location and number of the dielectric members 29*a*, 29*b* relative to the center of the antenna assembly 20. Moreover, the location and number of the dielectric members 29*a*, 29*b* may be chosen based upon a desired operating frequency, bandwidth, return loss, and lobe location, for example. Other factors may be considered in determining the number and location of choke members and thus choke slots.

Figure 3B:
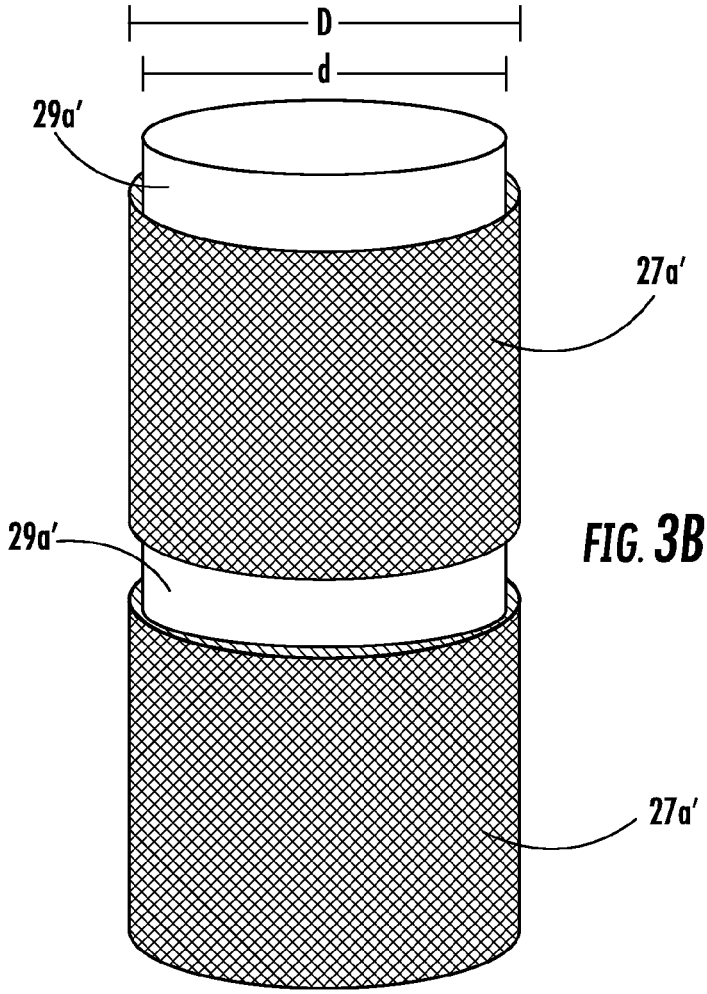
FIGS. 3B and 3C are schematic diagrams illustrating various embodiments of portions of the antenna assembly of FIG. 3A.
Figure 3C:
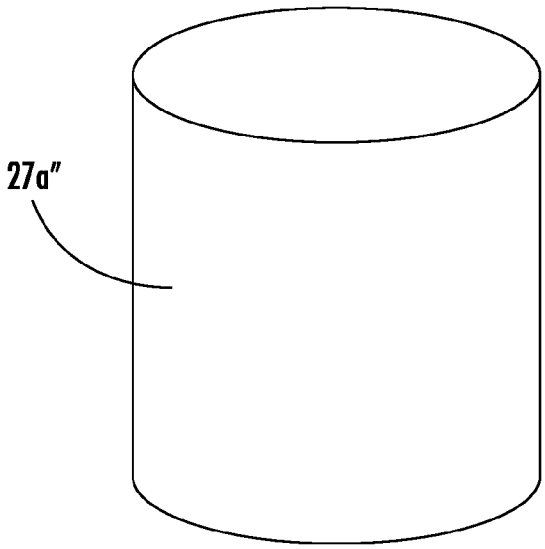

As illustrated in FIG. 3B, each of the plurality of cylindrical antenna body portions 27*a*' comprises a tubular cylindrical antenna body portion and/or a mesh electrical conductor. Each of the dielectric members 29*a*' comprises a cylindrical dielectric member, and a diameter d of each of the cylindrical dielectric members may be different than a diameter D of adjacent cylindrical antenna body portions 27*a*', as also illustrated in FIG. 3B. As illustrated in FIG. 3C, each of the plurality of cylindrical antenna body portions 27*a*" comprises a solid cylindrical antenna body portion, and/or a continuous electrical conductor.

Figure 6:
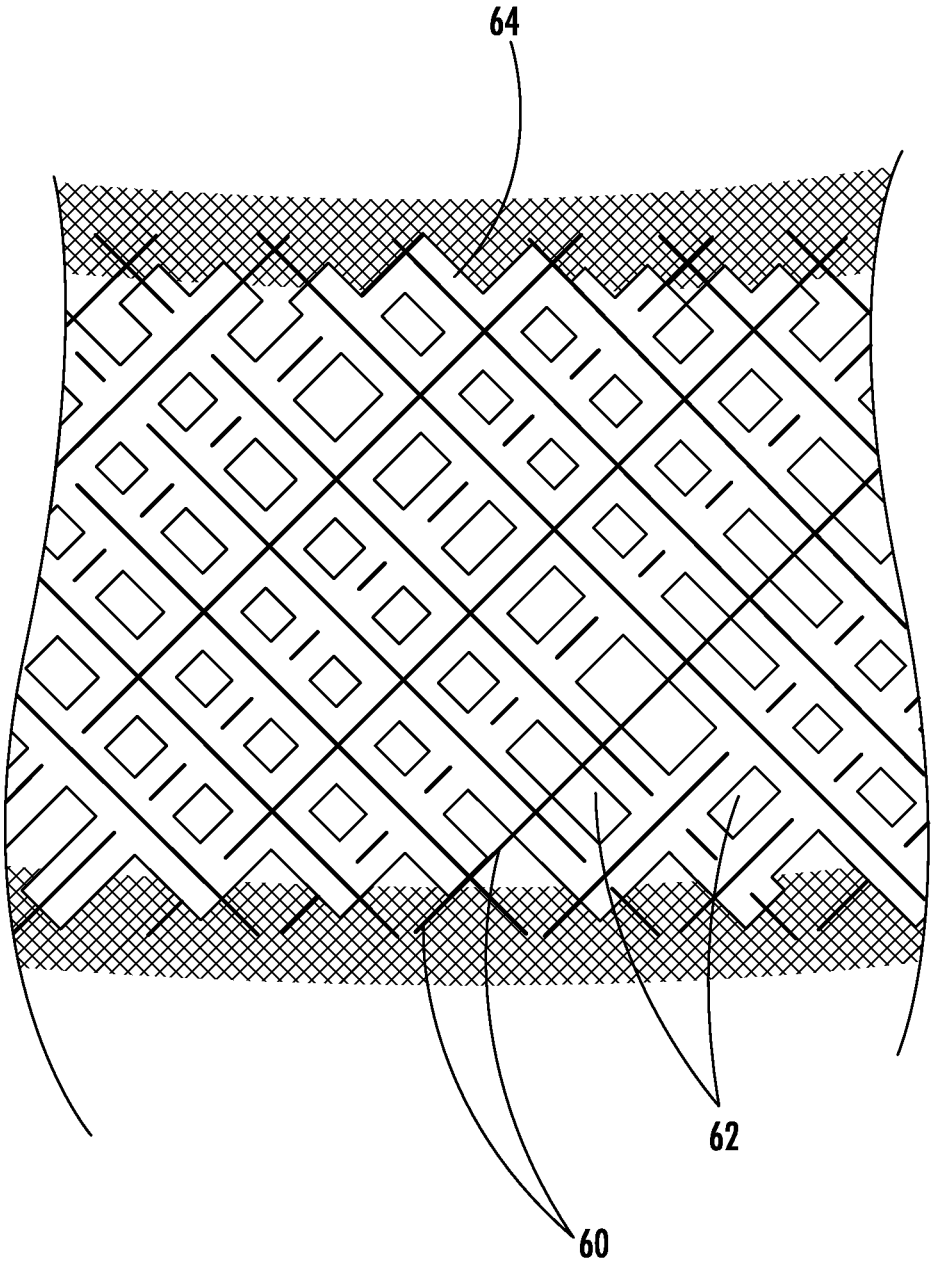
FIG. 6 is an exploded view of an inductive mesh in the antenna embodiment of FIG. 3B.

Referring to FIG. 6 an exploded view of an inductive mesh is provided. The inductive mesh may be used to form individual cylindrical antenna body portions 27*a*, 27*b* and it provides a distributed self inductance that may reduce the physical length requirements, e.g. inductive loading. In FIG. 6, metal wires 60, preferentially a copper metal wire, is coated with an insulation coating 62 such as enamel paint or lacquer. The weave may be a plain or linen weave with the insulated metal wires 60 oriented on a diagonal bias relative the antenna 20 elongate axis. The insulated metal wires are soldered to metal bands 64 to provide to prevent fraying. As can be appreciated by those in the art, the electrical currents should follow a diagonal and weaving path which provides increased conductor electrical length and increased self inductance. This in turn reduces antenna operating frequency and or physical size of the antenna 20.

The conical antenna body 22*a* of the first antenna element 21*a* has an opening 25*a* at the apex 31*a* thereof. A tubular dielectric spacer 24 is positioned in the opening 25*a* for receiving an inner conductor 41 of a coaxial cable 40, or other conductor, for example. The conical antenna body 22*b* of the second antenna element 21*b* may be similarly configured with an opening 25*b* at an apex 31*b* thereof, and may have a connector (not shown) therein for receiving the inner conductor 41.

The antenna assembly 20 includes a hollow shaft 28*a* in the first antenna element 21*a*, and the coaxial cable 40 extends through the hollow shaft 28*a*. The inner conductor 41 is coupled to the conical antenna body 22*b* of the second antenna element 21*b*. The inner conductor 41 passes through the tubular dielectric spacer 24 in the apex 31*a* of the first antenna element 21*a* to couple with the conical antenna body 22*b* of the second antenna element 21*b*. A coaxial cable connector (not shown) may be included in the conical antenna body 22*b* of the second antenna element 21*b* for coupling to the center conductor 41.

The coaxial cable 40 also includes an outer conductor 42 surrounding the inner conductor 41 and coupled to the cylindrical antenna body 26*a* of the first antenna element 21*a*. Other types of conductors may extend through the hollow shaft, for example a rigid conductor. Additionally, a second hollow shaft 28*b* may also be included, thus reducing manufacturing costs by reducing the amount of material used and the machining of two different antenna elements 21*a*, 21*b*. In some embodiments, the cylindrical antenna body portions 26*a*, 26*b* may not be hollow (e.g. as shown in FIG. 3C).

Each of the first and second conical antenna bodies 22*a*, 22*b* are illustratively aligned along a common longitudinal axis 23 with respective apexes 31*a*, 31*b* in opposing relation to define a symmetrical biconical-type dipole antenna.

The overall height of the first and second adjacent antenna elements 21*a*, 21*b* is typically determined by the desired highest operating frequency. The overall height of the antenna 20 is typically determined by the lowest operating frequency. The height of the antenna may also be determined based upon a size limitation of a device housing, for example. The lengths of the individual cylindrical antenna body portions 27*a*, 27*b* may be unequal so each cylindrical body portion may provide tuning to a portion of the radio frequency spectrum.

The antenna assembly 20 may further include a balun (not shown). A balun may be desired based upon how the coaxial cable 40 or conductor is attached to the conical antenna body 22*a*, 22*b*. The balun may advantageously balance the RE signals in each of the first and second adjacent antenna elements 21*a*, 21*b*.

Figure 4A:
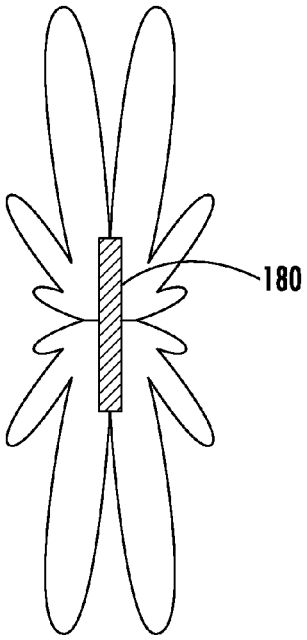
FIG. 4A is a schematic diagram illustrating a sample radiation pattern of the antenna of FIG. 2A in accordance with the prior art.
Figure 4B:
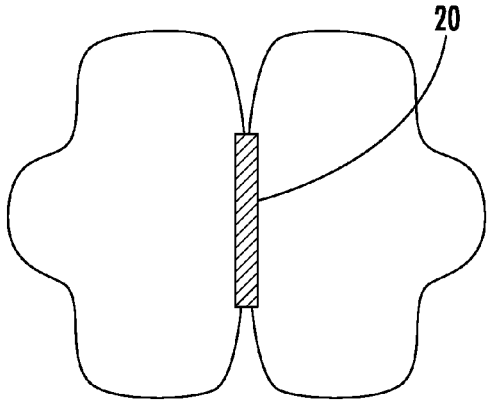
FIG. 4B is a schematic diagram illustrating a sample radiation pattern of the antenna assembly of FIG. 3.
Figure 5A:
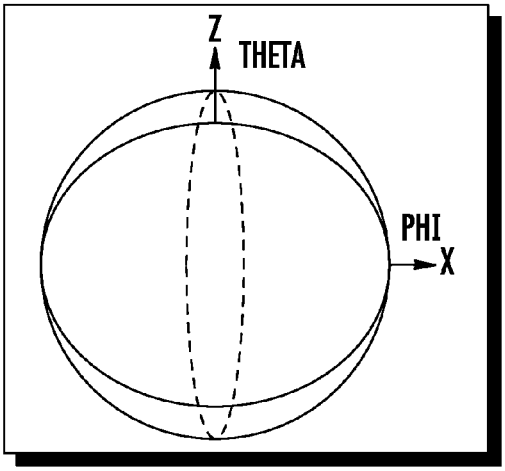
FIGS. 5A and 5B are respective graphs of low and high frequency gain patterns of the antenna of FIG. 3.
Figure 5B:
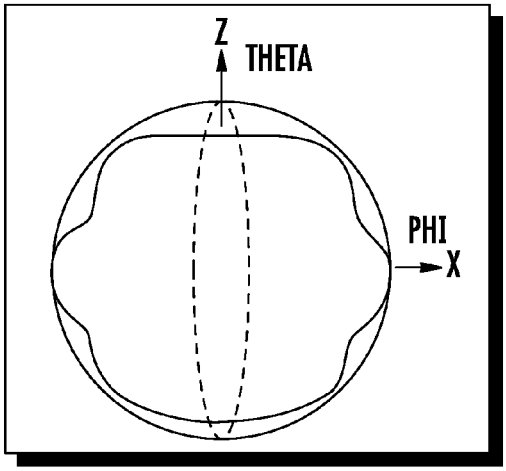

Referring now to the elevation plane radiation patterns in FIGS. 4A and 4B, the dielectric separators advantageously reduce "lobing" at certain frequencies, thus reducing nulls in the radiation pattern of the antenna assembly 20 that are located on the horizon, for example. The antenna is oriented along the Z axis so the XY plane represent the horizon. The gain patterns in the graphs illustratively have improved performance over the prior art antennas, whose gain patterns are illustrated in the graphs of FIGS. 1B, 1C, 2B, and 2C.

A method aspect is directed to making an antenna assembly 20 including forming first and second adjacent antenna elements 21*a*, 21*b* each comprising a conical antenna body 22*a*, 22*b* having a base 32*a*, 32*b* and an apex 31*a*, 31*b* opposite the base. A cylindrical antenna body 26*a*, 26*b* extends from the base 32*a*, 32*b* of the conical antenna body, and includes a plurality of adjacent cylindrical antenna body portions 27*a*, 27*b*, and a respective dielectric member 29*a*, 29*b* separating adjacent cylindrical antenna body portions. The method further includes aligning each of the first and second adjacent antenna elements 21*a*, 21*b* along a common longitudinal axis 23 with respective apexes 31*a*, 31*b* in opposing relation to define a dipole antenna.

For example, an antenna assembly was formed to have a height of 12 inches and a diameter of 1.5 inches. The antenna assembly exhibits operation from 240 MHz to 3 GHz with reduced or no nulls on the horizon, for example as illustrated in the graphs of FIGS. 4A and 4B. In contrast, a prior art antenna, without the dielectric separators, exhibited nulls between 800 and 900 MHz.

The antenna assembly 20 matches to very broad bands, with the lowest band of operation being dictated by the length of the antenna, and the highest band of operation being dictated by the accuracy of the dimensions near the center of the antenna. Desirable radiation pattern performance is achieved while a relatively small diameter.

Accordingly, the antenna assembly 20 may be particularly advantageous in a frequency range of about 240 MHz to 3 GHz, and in ultra-wideband applications, for example. Of course, the antenna assembly 20 may be used for other frequency ranges and other applications.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly comprising:

first and second adjacent antenna elements each comprising a conical antenna body having a base and an apex opposite the base, a cylindrical antenna body extending from the base of said conical antenna body, and including a plurality of adjacent cylindrical antenna body portions, and a respective dielectric member separating adjacent cylindrical antenna body portions;

each of said first and second adjacent antenna elements aligned along a common longitudinal axis with respective apexes in opposing relation to define a dipole antenna.

2. The antenna assembly according to claim 1, wherein each of the plurality of cylindrical antenna body portions comprises a tubular cylindrical antenna body portion.

3. The antenna assembly according to claim 1, wherein each of the plurality of cylindrical antenna body portions comprises a solid cylindrical antenna body portion.

4. The antenna assembly according to claim 1, wherein each of the plurality of cylindrical antenna body portions comprises a mesh electrical conductor.

5. The antenna assembly according to claim 1, wherein each of the plurality of cylindrical antenna body portions comprises a continuous electrical conductor.

6. The antenna assembly according to claim 1, wherein each of the dielectric members comprises a cylindrical dielectric member.

7. The antenna assembly according to claim 6, wherein a diameter of each of the cylindrical dielectric members is different than a diameter of adjacent cylindrical antenna body portions.

8. The antenna assembly according to claim 1, further comprising an antenna feed assembly coupled to the first and second adjacent antenna elements.

9. The antenna assembly according to claim 1, wherein the plurality of adjacent cylindrical body portions includes at least three cylindrical body portions with respective dielectric members therebetween.

10. An antenna assembly comprising:

first and second adjacent antenna elements each comprising a tapered antenna body having a base and an apex opposite the base, an elongated antenna body extending from the base of the tapered antenna body, and including a plurality of adjacent elongated antenna body portions, and a respective dielectric member separating adjacent elongated antenna body portions;

each of said first and second adjacent antenna elements having respective apexes in opposing relation to define a dipole antenna.

11. The antenna assembly according to claim 10, wherein each of the plurality of elongated antenna body portions comprises a hollow elongated antenna body portion.

12. The antenna assembly according to claim 10, wherein each of the plurality of elongated antenna body portions comprises a solid elongated antenna body portion.

13. The antenna assembly according to claim 10, wherein each of the plurality of elongated antenna body portions comprises a mesh electrical conductor.

14. The antenna assembly according to claim 10, wherein each of the plurality of elongated antenna body portions comprises a continuous electrical conductor.

15. The antenna assembly according to claim 10, wherein a width of each of the dielectric members is different than a width of adjacent elongated antenna body portions.

16. The antenna assembly according to claim 10, further comprising an antenna feed assembly coupled to the first and second adjacent antenna elements.

17. A method of making antenna assembly comprising:

forming first and second adjacent antenna elements each comprising a conical antenna body having a base and an apex opposite the base, a cylindrical antenna body extending from the base of said conical antenna body, and including a plurality of adjacent cylindrical antenna body portions, and a respective dielectric member separating adjacent cylindrical antenna body portions;

aligning each of said first and second adjacent antenna elements along a common longitudinal axis with respective apexes in opposing relation to define a dipole antenna.

18. The method according to claim 17, wherein forming comprises forming each of the plurality of adjacent cylindrical antenna body portions as a tubular cylindrical antenna body portion.

19. The method according to claim 17, wherein forming comprises forming each of the plurality of adjacent cylindrical antenna body portions as a solid cylindrical antenna body portion.

20. The method according to claim 17, wherein forming comprises forming each of the plurality of adjacent cylindrical antenna body portions as a mesh electrical conductor.

21. The method according to claim 17, wherein forming comprises forming each of the plurality of adjacent cylindrical antenna body portions as a continuous electrical conductor.

22. The method according to claim 17, wherein forming comprises forming each of the dielectric members as a cylindrical dielectric member.

23. The method according to claim 22, wherein forming comprises forming a diameter of each of the cylindrical dielectric members different than a diameter of adjacent cylindrical antenna body portions.

24. The method according to claim 17, further comprising coupling an antenna feed assembly to the first and second adjacent antenna elements.

* * * * *